US006648988B2

(12) United States Patent
Ramanarayanan et al.

(10) Patent No.: US 6,648,988 B2
(45) Date of Patent: Nov. 18, 2003

(54) FURNACE RUN LENGTH EXTENSION BY FOULING CONTROL

(75) Inventors: Trikur Anantharaman Ramanarayanan, Somerset, NJ (US); Ashok Uppal, Brights Grove (CA); Changmin Chun, Lawrenceville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/931,715

(22) Filed: Aug. 17, 2001

(65) Prior Publication Data

US 2003/0035889 A1 Feb. 20, 2003

(51) Int. Cl.[7] ..... C23C 8/04

(52) U.S. Cl. ..... 148/280; 148/284; 148/286; 134/8

(58) Field of Search ..... 148/280, 284, 148/286; 134/8

(56) References Cited

U.S. PATENT DOCUMENTS

| | | | | | |
|---|---|---|---|---|---|
| 4,543,131 | A | | 9/1985 | Purinton, Jr. | 134/8 |
| 4,581,074 | A | | 4/1986 | Mankina et al. | 134/2 |
| 5,169,515 | A | * | 12/1992 | Ngan et al. | 148/280 |
| 5,630,887 | A | * | 5/1997 | Benum et al. | 148/280 |
| 6,067,682 | A | * | 5/2000 | Rankin | 15/104.061 |

FOREIGN PATENT DOCUMENTS

| | | | |
|---|---|---|---|
| DE | 4304735 A1 | 8/1994 | B08B/9/02 |
| EP | 0602347 A1 | 6/1994 | C23C/8/06 |
| WO | WO94/14923 | 7/1994 | C10G/9/16 |

OTHER PUBLICATIONS

Huntington Alloy Pamphlet, INCOLOY, Nickel–Iron–Chromium Alloys, INCOLOY 800, The International Nickel Company, Inc., 1973, p. 1.*

* cited by examiner

*Primary Examiner*—John Sheehan
*Assistant Examiner*—Andrew L. Oltmans
(74) *Attorney, Agent, or Firm*—Estelle C. Bakun; Charles J. Brumlik

(57) ABSTRACT

Furnace run length extension by fouling control utilizing a pigging-passivation process.

12 Claims, 4 Drawing Sheets

FURNACE RUN LENGTH EXTENSION BY FOULING CONTROL

BACKGROUND OF THE INVENTION

Furnaces that process refinery feedstocks, particularly feedstocks high in sulfur compounds, are subject to fouling at temperatures of ~700° F. Typically the foulant consists of both inorganic corrosion products and carbonaceous deposits. Fouling adversely affects process economics by shortening furnace run lengths. While a conventional pigging process is effective in cleaning the furnace tubes, such cleaning exposes fresh tube metal to corrosive attack by sulfur compounds and in turn accelerated fouling. What is needed is an effective cleaning method that is capable of protecting the unit from corrosive attack by sulfur containing compounds and hence prevents fouling.

SUMMARY OF THE INVENTION

The invention includes a two step cleaning method for metal surfaces, which protects the surfaces from fouling. The method is particularly applicable to units which process sulfur containing feeds in which fouling occurs due to metal surface corrosion caused by the sulfur containing compounds in the feeds being processed in the units.

A method for cleaning the surface of an alloy said alloy comprising a base metal and an alloying metal, wherein said alloying metals are selected from the group consisting of chromium, chromium in combination with silicon, chromium in combination with aluminum and chromium in combination with silicon and aluminum, wherein said base metal of said alloy is selected from iron, nickel, cobalt and mixtures thereof, comprising the steps of:

(a) pigging said alloy surface; and thereafter (b) passivating said alloy surface by contacting said surface with a gas comprising steam for a time and at a temperature sufficient to form at least one mixed oxide layer on said alloy wherein said mixed metal oxide contains an average alloying metal content of from equal to the alloying metal content in said alloy up to 100% alloying metal.

A method for increasing the run length in a refinery process conducted in a unit having alloy surfaces susceptible to fouling, said alloy comprising a base metal and an alloying metal, wherein said alloying metals are selected from the group consisting of chromium, chromium in combination with silicon, chromium in combination with aluminum and chromium in combination with silicon and aluminum, wherein said base metal of said alloy is selected from iron, nickel, cobalt and mixtures thereof, comprising the steps of:

(a) pigging said alloy surface; and thereafter (b) passivating said alloy surface by contacting said surface with a gas comprising steam for a time and at a temperature sufficient to form at least one mixed oxide layer on said alloy surface wherein said mixed metal oxide contains an average alloying metal content of from equal to the alloying metal content in said alloy up to 100% alloying metal.

Pigging is a well-known method of cleaning metal surfaces in process/transportation pipelines. For example, the skilled artisan need only refer to "Recent Innovations in Pigging Technology for the Removal of Hard Scale from Geothermal Pipelines," Arata, Ed; Erich, Richard; and Paradis, Ray, Transactions-Geothermal Resources Council (1996), 20, 723–727, Mitigation of Fouling in Bitumen Furnaces by Pigging, Richard Parker and Richard McFarlane, Energy & Fuels 2000, 14, 11–13, or other known references.

DETAILED DESCRIPTION OF THE INVENTION

Figure 1:
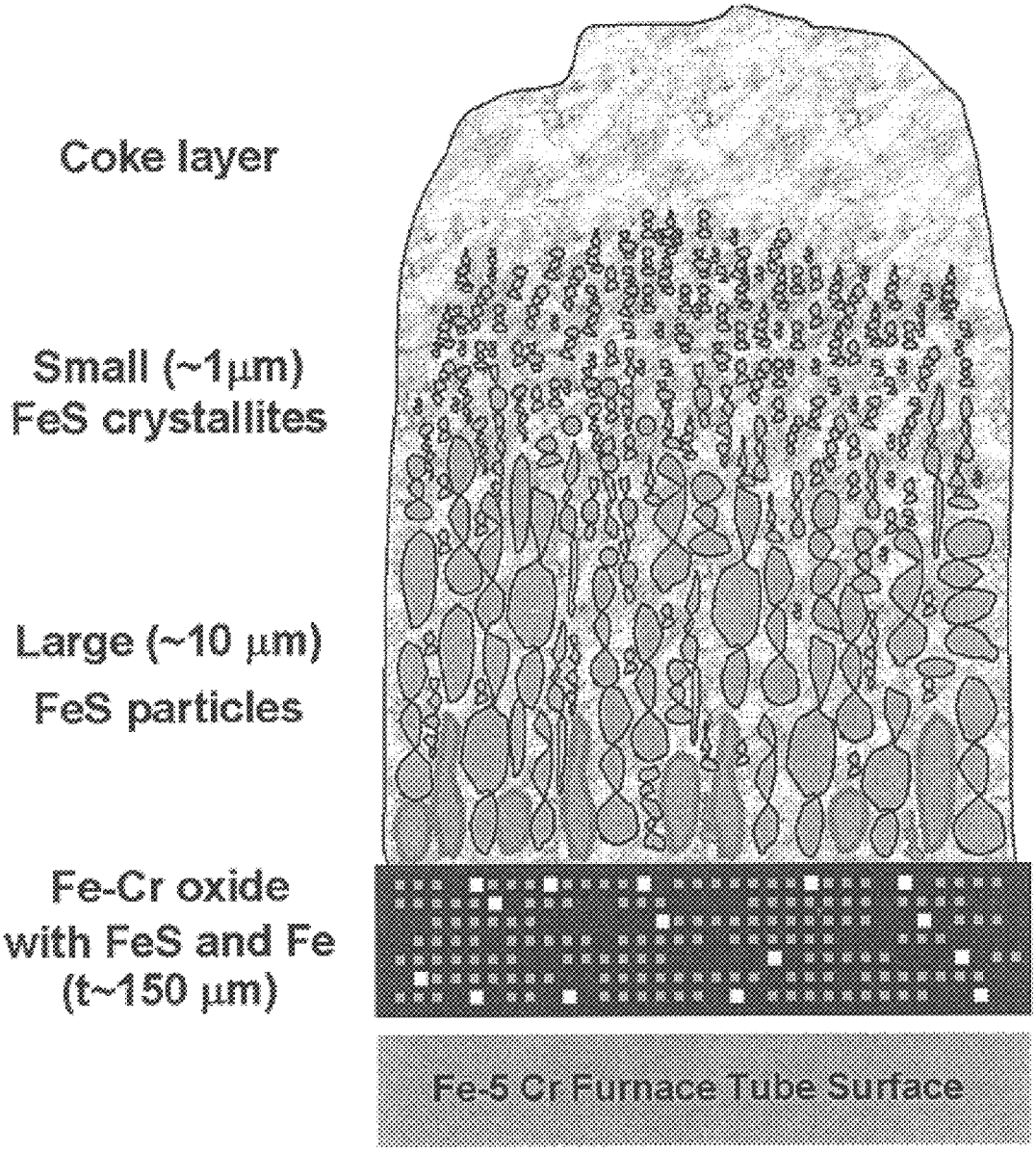
FIG. 1 depicts the fouling which occurs on a furnace tube surface due to sulfide particles.

The cleaning process herein is applicable to alloy surfaces where the alloy surfaces being cleaned are alloys comprised of alloying metals and base metal where the alloying metals are selected from chromium, aluminum, silicon and mixtures thereof where the base metal is selected from iron, nickel, cobalt and mixtures thereof. As used herein, the base metal is the predominant metal present in the alloy. Hence the amount of base metal alone or in combination with another base metal if two or more base metals are present, will exceed the amount of alloying metal present. Preferably, the alloy will be a chromium alloy, more preferably, a chromium steel. The alloy will preferably contain from about 2 to about 20 wt % chromium, preferably from about 5 to about 9 wt % chromium. The amount of silicon in the alloy can range from about 0.25 to about 2 wt %, preferably from about 0.5 to about 1.5 wt %. The amount of aluminum in the alloy can range from about 0.5 to about 5 wt %, preferably from about 2 to about 4.5 wt %.

In the process of this invention, the pigging followed by passivation forms a protective oxide coating on the metal surface. This oxide coating may contain one or more of the metallic components in the alloy. For example, when using an Fe-5 Cr alloy, the oxide coating will contain both iron and Cr, the Cr content ranging from 5 wt % to about 9 wt %. With an alloy containing 20 wt % Cr, a pure chromium oxide coating is expected. When Si is present in the alloy, its concentration in the oxide coating can vary from about 2 to 10 wt %. When both Cr and Si are present in the alloy, for example, a Fe-20 Cr-2 Si alloy, the oxide coating may consist of an outer $Cr_2O_3$ layer and an inner $SiO_2$ layer. In Al-containing alloys, the content of Al in the oxide coating will depend upon the other metal components in the alloy. Thus, in an Fe-5Cr-2 Al alloy, the Al content in the oxide can vary from 2 to 10 wt %. When the alloy composition is Fe-20 Cr-5 Al, a substantially pure $Al_2O_3$ oxide coating is expected.

The oxides which form on the surface of the alloy being pigged and passivated, are typically about 1 to about 100, preferably about 5 to about 20 microns thick. In the process described, at least one oxide layer is formed. More than one layer can also form throughout the above thickness.

The gas comprising steam which is utilized for passivating the alloy surfaces following the pigging process may range from pure steam to a gas comprising a steam and oxygen mixture. The mixture may comprise steam with up to about 20% oxygen. Thus, a steam and air mixture may be utilized.

Typically the metal surfaces are passivated for times sufficient to form at least one layer of an oxide comprising an oxide of the alloying component of the alloy. In many instances a two layer protective film will form on the alloy surface. The oxide will have an average alloying metal content equal to that of the alloy up to 100% of the alloying component throughout its thickness. Thus, the metal oxide can range from a pure metal oxide of the alloying component to a metal oxide with an alloying component content equal to that of the alloy being pigged and passivated. For example for a Fe-20 Cr alloy, the average chromium content in the oxide throughout its thickness, and regardless of the number of layers present can range from a 20 wt % chromium oxide to pure chromium oxide. Passivation times can range from about 10 hours, up to the amount of time sufficient to form a pure oxide film of the alloying component. Preferably, times will range from about 10 to about 100 hours.

The temperatures utilized during the passivation process will be dependent on the metallurgy of the alloy being acted upon. The skilled artisan can easily determine the upper temperature constraints based on the alloy's metallurgy. Typically, temperatures of greater than about 800° F. will be utilized, preferably from about 800 to about 2000° F. will be utilized.

It is believed that the oxide formed on the surface of the alloy suppresses the formation of catalytic sulfide particles. In processes in which such alloys are utilized, sulfide induced fouling occurs whereby sulfide particles form and increase deposition of carbonaceous materials to decrease process efficiency and run length. The protective oxide formed herein prevents formation of sulfide particles and allows longer run length in such processes. Furthermore, other types of fouling may likewise be suppressed.

The following examples are illustrative of the invention but are not meant to be limiting.

EXAMPLE 1

Figure 2:
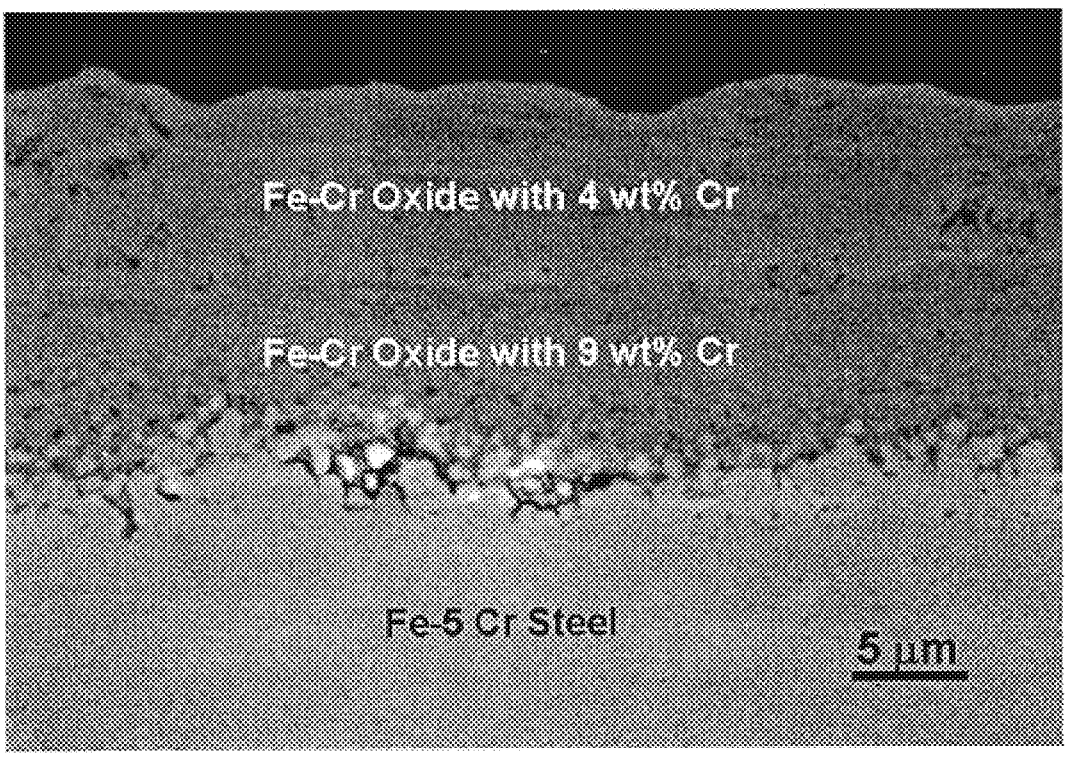
FIG. 2 is a photomicrograph of the layers which form an alloy surface according to the invention.
Figure 3:
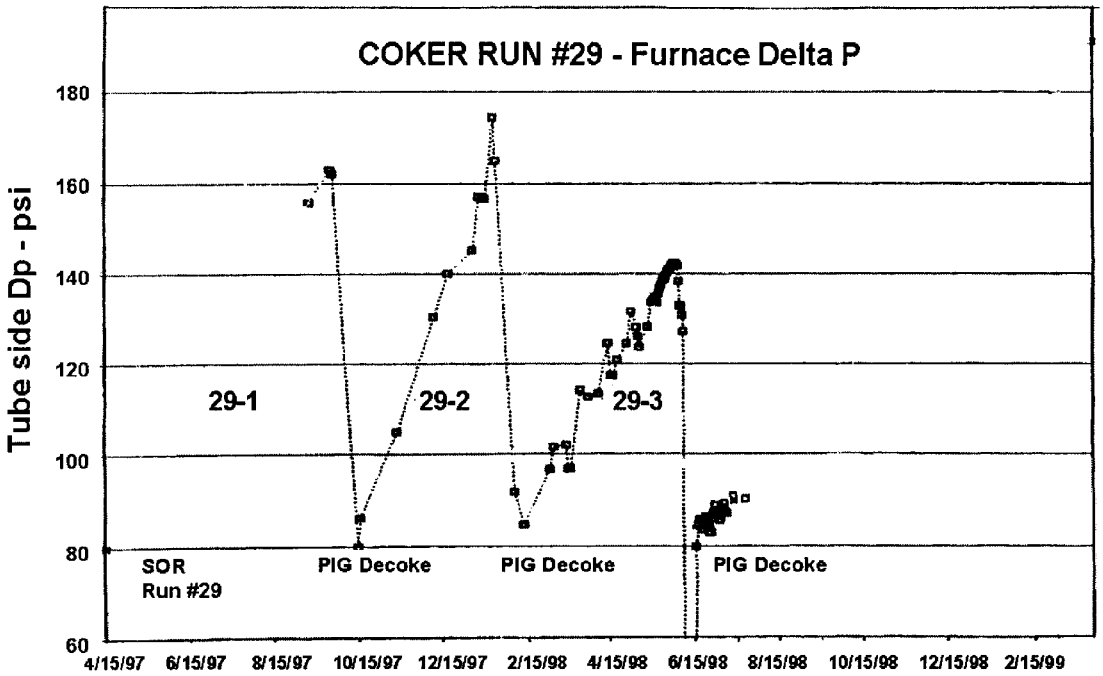
FIG. 3 depicts a typical coker furnace run where pigging is performed absent passivation as taught herein. It shows that the run must be terminated at several points and the unit re-pigged.
Figure 4:
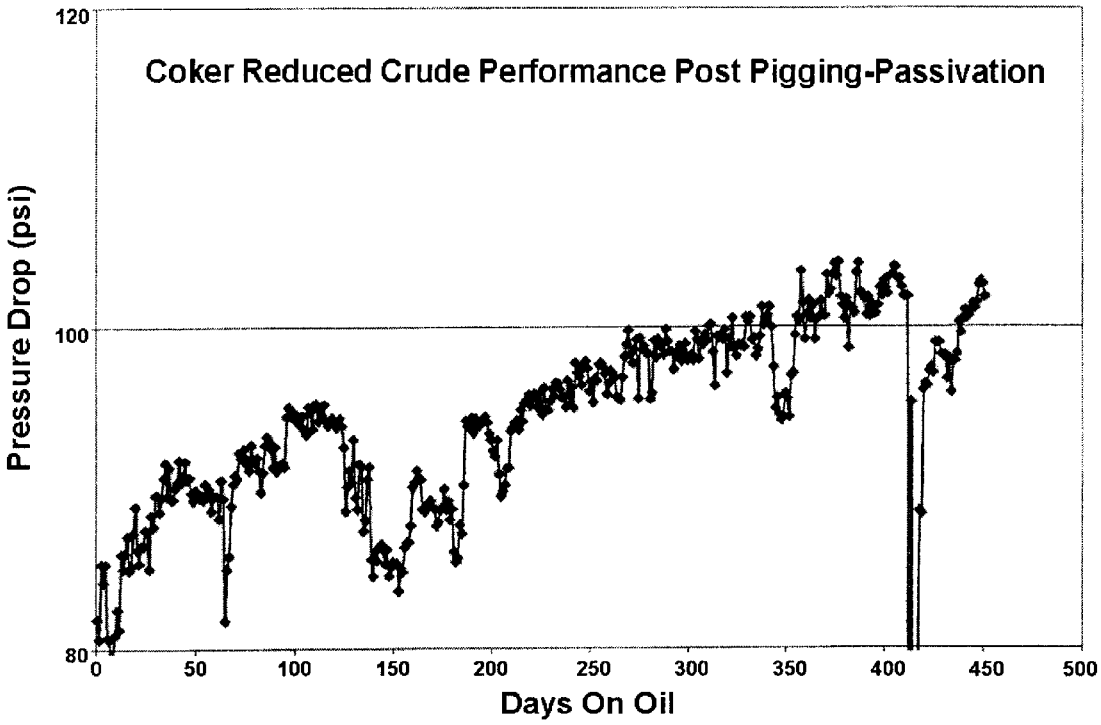
FIG. 4 depicts a typical coker furnace run where the two step pigging-passivation method taught herein has been conducted and the extended number of days the run can be conducted without stopping the unit as required in the run depicted in FIG. 3.

Following a typical furnace run, the furnace tubes were pigged followed by passivation using a steam/air mixture containing 10–15 ppm oxygen at approximately 1200° F. for 15 hours for each of the two sets of tubes. In order to measure the effectiveness of this procedure, a coupon of Fe-5-Cr alloy was installed at the furnace exit and exposed to the same conditions during this procedure. However, since two lines were cleaned, the coupon was exposed for a total of 30 hours. A cross sectional scanning electron micrograph, FIG. 2, shows that the steam pre-treatment has resulted in a two-layered surface oxide: an outer iron-chromium oxide having about 4 wt %. of Cr and an inner iron-chromium oxide containing roughly 9 wt % Cr.

Applicants believe that the two-layered mixed iron-chromium oxide suppresses the formation of catalytic sulfide particles.

What is claimed is:

1. A method of cleaning the surface of an alloy said alloy comprising a base metal and an alloying metal, wherein said alloying metals are selected from the group consisting of chromium, chromium in combination with silicon, chromium in combination with aluminum and chromium in combination with silicon and aluminum, wherein said base metal of said alloy is selected from iron, nickel, cobalt and mixtures thereof, and wherein the alloy has no more than about 20 wt % chromium, comprising the steps of:

(a) pigging said alloy surface; and thereafter (b) passivating said alloy surface by contacting said surface with at least one gas selected from the group consisting of steam, a mixture of steam and oxygen, a mixture of steam and air, and a mixture of steam and oxygen and air, such that the mixture has 0–20 wt % free $O_2$ for a time an at a temperature sufficient to form at least one mixed oxide layer on said alloy where n said mixed metal oxide contains an average alloying metal content of from equal to the alloying metal content in said alloy to up to 100% alloying metal.

2. A method for increasing the run length in a refinery process conducting in a unit having alloy surfaces susceptible to fouling, said alloy comprising a base metal and an alloying metal, wherein said alloying metals are selected from the group consisting of chromium, chromium in combination with silicon, chromium in combination with aluminum and chromium in combination with silicon and aluminum, wherein said base metal of said alloy is selected from iron, nickel, cobalt and mixtures thereof, and wherein the alloy has no more than about 20 wt % chromium, comprising the steps of:

(a) pigging said alloy surface and thereafter (b) passivating said alloy surface by contacting said surface with at least one gas selected from the group consisting of steam, a mixture of steam and oxygen, a mixture of steam and air, and a mixture of steam and oxygen and air, such that the mixture has 0–20 wt % free $O_2$ for a time a d at a temperature sufficient to form at least one mixed oxide layer on said alloy wherein said mixed metal oxide contains an average alloying metal content of from equal to the alloying metal content in said alloy to up to 100% alloying metal.

3. The method of claim 1 wherein said alloy is a chromium steel containing from about 2 to about 20 wt % chromium.

4. The method of claim 1 wherein said mixed metal oxide layer is about 1 to about 100 microns thick.

5. The method of claim 1 wherein said temperature is greater than about 800° F.

6. The method of claim 1 wherein said temperature ranges from about 800 to about 2000° F.

7. The method of claim 1 wherein said time ranges from about 10 to about 100 hours.

8. The method of claim 1 wherein said gas comprising steam is a mixture of steam and up to about 20 wt % oxygen.

9. The method of claim 1 wherein alloy is an aluminum containing alloy containing from about 0.5 to a out 5 wt % aluminum.

10. The method of claim 1 wherein said alloy is a silicon containing alloy containing from about 0.25 to bout 2 wt % silicon.

11. A method of cleaning the surface of an alloy said alloy comprising a base metal and an alloying metal, wherein said alloying metals are selected from the group consisting of chromium, chromium in combination with silicon, chromium in combination with aluminum and chromium in combination with silicon and aluminum, wherein said base metal of said alloy is selected from iron, nickel, cobalt and mixtures thereof and wherein the alloy has about 5 to about 9 wt % chromium, comprising the steps at (a) pigging said alloy surface; and thereafter (b) passivating said alloy surface by contacting said surface with a gas comprising steam for a time and at a temperature sufficient to form at least one mixed oxide layer on said alloy wherein said mixed metal oxide contains an average alloying metal content of from equal to the alloying metal content in said alloy to up to 100% alloying metal.

12. A method far increasing the run length in a refinery process conducting in a unit having alloy surfaces susceptible to fouling, said alloy comprising a base metal and an alloying metal, wherein said alloying metals are selected from the group consisting of chromium, chromium in combination with silicon, chromium in combination with aluminum and chromium in combination with silicon and aluminum, wherein said base metal of said alloy is selected from iron, nickel, cobalt and mixtures thereof, and wherein the alloy has about 5 to about 9 wt % chromium, comprising the steps of:

(a) pigging said alloy surface; and thereafter (b) passivating said alloy surface by contacting said surface with a gas comprising steam for a time and at a temperature sufficient to form at least one mixed oxide layer on said alloy wherein said mixed metal oxide contains an average alloying metal content of from equal to the alloying metal content in said alloy to up to 100% alloying metal.

* * * * *